US009902172B2

(12) United States Patent
Ishikawa et al.

(10) Patent No.: US 9,902,172 B2
(45) Date of Patent: Feb. 27, 2018

(54) PRINTER APPARATUS

(71) Applicant: FUJITSU COMPONENT LIMITED, Tokyo (JP)

(72) Inventors: Tetsuhiro Ishikawa, Tokyo (JP); Sumio Watanabe, Tokyo (JP); Yukihiro Mori, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/310,148

(22) PCT Filed: May 26, 2015

(86) PCT No.: PCT/JP2015/065138
§ 371 (c)(1),
(2) Date: Nov. 10, 2016

(87) PCT Pub. No.: WO2015/182620
PCT Pub. Date: Dec. 3, 2015

(65) Prior Publication Data

US 2017/0144455 A1 May 25, 2017

(30) Foreign Application Priority Data

May 30, 2014 (JP) ..... 2014-113251

(51) Int. Cl.
*B41J 11/04* (2006.01)
*B41J 2/32* (2006.01)

(52) U.S. Cl.
CPC ..... *B41J 11/04* (2013.01); *B41J 2/32* (2013.01)

(58) Field of Classification Search
CPC ..... B41J 11/04; B41J 2/32; B41J 11/13; B41J 11/10; B41J 11/08; B41J 11/06; B41J 11/057; B41J 11/053; B41J 11/02
See application file for complete search history.

(56) References Cited

U.S. PATENT DOCUMENTS 6,814,515 B2 11/2004 Tsuchiya et al.
2002/0021927 A1 2/2002 Mori et al.
(Continued)

FOREIGN PATENT DOCUMENTS

EP 1479525 11/2004
JP 2003-019845 1/2003
(Continued)

OTHER PUBLICATIONS

International Search Report dated Aug. 11, 2015.

*Primary Examiner* — Kristal Feggins
(74) *Attorney, Agent, or Firm* — IPUSA, PLLC

(57) ABSTRACT

A printer apparatus includes a print head, a platen roller having a rod, a spring configured to press the print head toward a direction of the platen roller, a frame having in a side face thereof a platen supporting groove for supporting the rod of the platen roller, and a detection switch, wherein the platen supporting groove includes a first edge situated toward a direction of the print head and a second edge situated opposite from the first edge, and has on the second edge a projection projecting toward inside the platen supporting groove, and wherein placing the rod of the platen roller at a predetermined position at a deeper side of the platen supporting groove than the projection causes the rod of the platen roller to press the detection switch due to an urging force that is applied to the platen roller by the spring through the print head.

4 Claims, 13 Drawing Sheets

(56) References Cited

U.S. PATENT DOCUMENTS

| | | | |
|---|---|---|---|
| 2008/0180468 | A1 | 7/2008 | Takahashi |
| 2014/0232806 | A1 | 8/2014 | Tsuchiya et al. |

FOREIGN PATENT DOCUMENTS

| | | |
|---|---|---|
| JP | 2003-127445 | 5/2003 |
| JP | 2008-179087 | 8/2008 |
| JP | 2012-106511 | 6/2012 |
| JP | 2013-086282 | 5/2013 |

PRINTER APPARATUS

TECHNICAL FIELD

The disclosures herein relate to a printer apparatus.

BACKGROUND ART

Printers for producing sales receipts or the like are widely used in cash registers used in stores, ATMs (automatic teller machines) or CDs (cash dispensers) installed in banks, etc. In a printer for producing sales receipts or the like, a thermal head or the like prints on thermal paper serving as recording paper while the recording paper is advanced. After the recording paper is advanced a predetermined length, a cutter apparatus cuts a predetermined length of the recording paper from the rest of the paper.

Such a cutter apparatus has a fixed blade and a movable blade. The movable blade is moved toward the fixed blade to cut recording paper that is placed between the fixed blade and the movable blade.

RELATED-ART DOCUMENTS

Patent Document

[Patent Document 1] Japanese Patent Application Publication No. 2003-19845

SUMMARY OF THE INVENTION

Problem to be Solved by the Invention

In the above-noted printer apparatus that uses a thermal head or the like to print on recording paper, the recording paper is placed between the thermal head for printing and a platen roller for advancing the recording paper, and printing is performed while the thermal head is pressed against the platen roller.

Further miniaturization and cost reduction are required of such a printer apparatus.

Means to Solve the Problem

According to an aspect of the embodiments, a printer apparatus includes a print head, a platen roller having a rod, a spring configured to press the print head toward a direction of the platen roller, a frame having in a side face thereof a platen supporting groove for supporting the rod of the platen roller, and a detection switch, wherein the platen supporting groove includes a first edge situated toward a direction of the print head and a second edge situated opposite from the first edge, and has on the second edge a projection projecting toward inside the platen supporting groove, and wherein placing the rod of the platen roller at a predetermined position at a deeper side of the platen supporting groove than the projection causes the rod of the platen roller to press the detection switch due to an urging force that is applied to the platen roller by the spring through the print head.

Advantage of the Invention

According to at least one embodiment, miniaturization and cost reduction are achieved in respect of a printer apparatus using a thermal head or the like.

MODE FOR CARRYING OUT THE INVENTION

Figure 1:
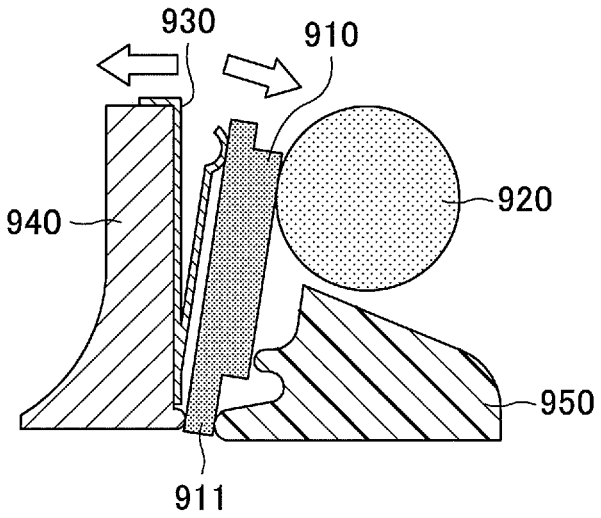
FIG. 1 is a drawing illustrating the structure of a printer apparatus.

In the following, embodiments for implementing the invention will be described. The same members or the like are referred to by the same numerals, and a description thereof will be omitted A description will be first given of a typical printer apparatus using a thermal head by referring to FIG. 1 and FIGS. 2A and 2B. The printer apparatus using a thermal head illustrated in FIG. 1 includes a thermal head 910 serving as a print head for printing on recording paper and a platen roller 920 for conveying the recording paper. Recording paper (not shown) for printing, which is placed between the thermal head 910 and the platen roller 920, is advanced by the rotation of the platen roller 920 while the thermal head 910 prints on the recording paper. In such a printer apparatus, a spring 930 presses the thermal head 910 toward the platen roller 920. The spring 930 which is a head pressuring spring has a letter-V shape. The spring 930 in the installed state in the printer apparatus exerts a restoring force such that the letter-V shape widens. The spring 930, which is installed between a frame 940 and the thermal head 910, exerts a restoring force acting in the direction in which the letter-V widens as illustrated by arrows, thereby pressing the thermal head 910 toward the platen roller 920.

In the case of being formed of metal die cast such as aluminum, the frame 940 exhibits high strength, and does not deform even when the spring 930 is placed between the frame 940 and the thermal head 910. Due to requirements for cost reduction, however, the frame 940 may be formed of resin material. In such a case, the resin material is easy to deform, so that installing the spring 930 between the frame 940 and the thermal head 910 to cause the restoring force of the spring 930 to press the frame 940 made of resin material possibly deforms the frame 940. The force exerted by the spring 930 to press the thermal head 910 toward the platen roller 920 may thus diminish. Further, the deformation of the frame 940 may possibly destroy the printer apparatus.

Figure 2A:
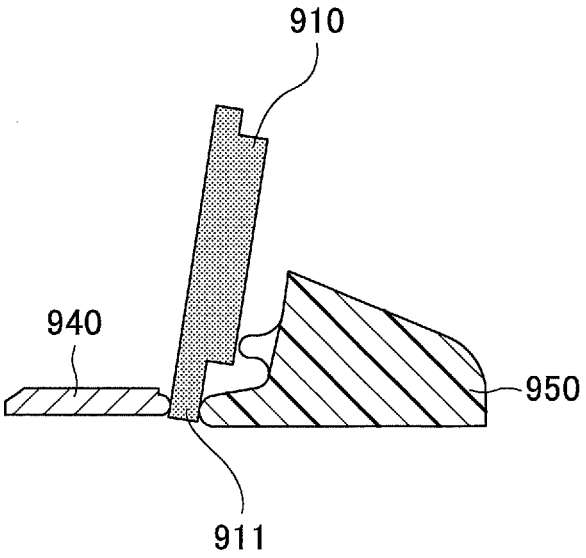
FIG. 2A is a drawing illustrating the printer apparatus.
Figure 2B:
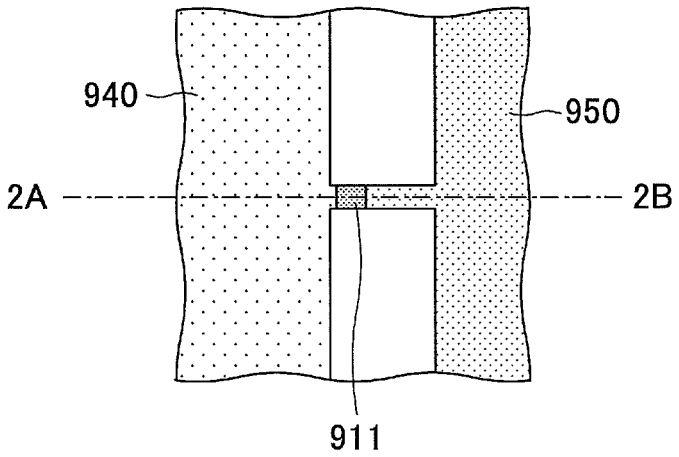
FIG. 2B is a drawing illustrating the printer apparatus.

Such a printer apparatus illustrated has a recording paper guide 950 made of resin material or the like for guiding the recording paper before entry into the space between the thermal head 910 and the platen roller 920. As illustrated in FIG. 2A, a projection 911 situated at an end of the thermal head 910 opposite from the side of the thermal head 910 for printing on the recording paper (not shown) is placed between the frame 940 and the recording paper guide 950. The projection 911 of the thermal head 910 serves as a rotation axis of the thermal head 910 when the spring 930 presses the thermal head 910 toward the platen roller 920. FIG. 2B is a bottom view of the printer apparatus. FIG. 2A is a cross-sectional view taken along a dot-and-dash line 2A-2B in FIG. 2B.

Figure 3A:
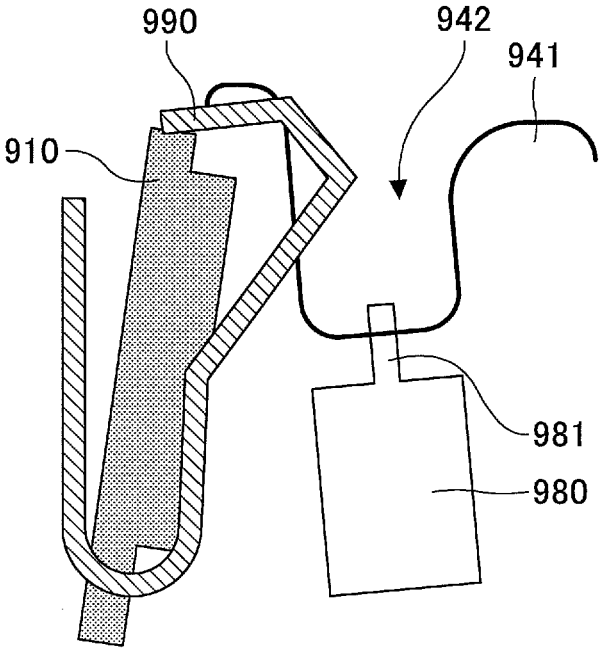
FIG. 3A is a drawing illustrating the printer apparatus.
Figure 3B:
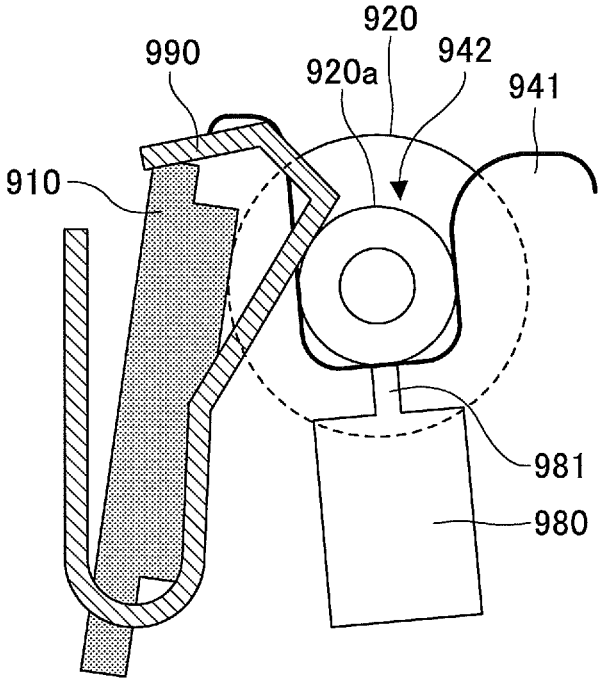
FIG. 3B is a drawing illustrating the printer apparatus.

As illustrated in FIG. 3A, a side face 941 of the frame has a platen supporting groove 942 formed therein for supporting the rod 920*a* of the platen roller 920. For the purpose of allowing other parts of the printer apparatus to be easily seen, only the outline of the side face 941 at the position of the platen supporting groove 942 is shown in a solid line, and the side face 941 of the frame is illustrated as being transparent. In this printer apparatus, a restoring force of a platen-rod holding spring 990 holds the rod 920*a* as illustrated in FIG. 3B when the rod 920*a* of the platen roller 920 is placed in the platen supporting groove 942 formed in the side face 941. This ensures that the rod 920*a* of the platen roller 920 is rotatably placed at a predetermined position in the platen supporting groove 942 formed in the side face 941 of the frame.

In FIG. 3A and FIG. 3B, a mechanical switch 980 attached to the side face 941 of the frame has a press part 981. Whether the rod 920*a* of the platen roller 920 is set in the platen supporting groove 942 can be detected based on the on or off state of the mechanical switch 980. Pressing down the press part 981 of the mechanical switch 980 causes the mechanical switch to be in the on (or off) state, thereby allowing the detection of the event that the rod 920*a* of the platen roller 920 is set in the predetermined position. In this manner, the printer apparatus illustrated in FIG. 3A and FIG. 3B has the press part 981 of the mechanical switch 980 that is pressed by the rod 920*a* of the platen roller 920 that is pressed by the platen-rod holding spring 990.

Figure 4:
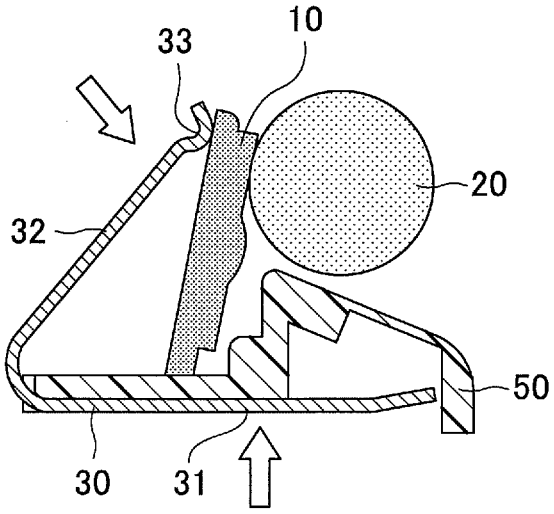
FIG. 4 is a drawing illustrating the structure of the printer apparatus according to the present embodiment.
Figure 5A:
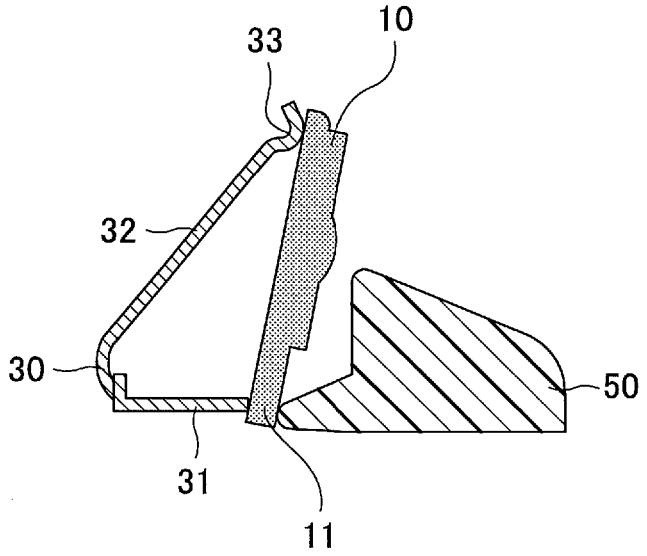
FIG. 5A is a drawing illustrating the printer apparatus of the present embodiment.
Figure 5B:
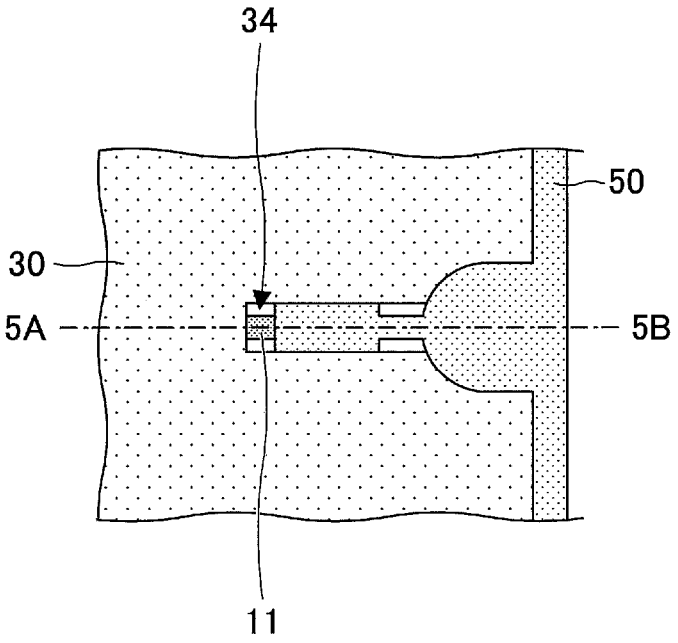
FIG. 5B is a drawing illustrating the printer apparatus of the present embodiment.

In the following, the printer apparatus of the present embodiment will be described with reference to FIG. 4 and FIGS. 5A and 5B. The printer apparatus of the present embodiment includes a thermal head 10 serving as a print head for printing on recording paper and a platen roller 20 for conveying the recording paper. Recording paper (not shown) for printing, which is placed between the thermal head 10 and the platen roller 20, is advanced by the rotation of the platen roller 20 while the thermal head 10 prints on the recording paper. In the present embodiment, the term "thermal head 10" may sometimes refer to the entire structure inclusive of a thermal head as well as a heat sink and the like attached to the thermal head.

The printer apparatus of the present embodiment has a letter-V spring 30 for pressing the thermal head 10 toward the platen roller 20. The letter-V spring 30, when installed in the printer apparatus as illustrated in FIG. 4, exerts a restoring force in the direction indicated by arrows in FIG. 4. Specifically, the restoring force acts in such a direction as to narrow the letter-V shape in the state illustrated in FIG. 4. Namely, the letter-V spring 30 is installed such that the restoring force serves to bring the first part 31 and the second part 32 of the letter-V spring 30 closer to each other. In the present embodiment, the first part 31 of the letter-V spring 30 is secured in contact with the recording paper guide 50 made of resin material, and a head contact 33 of the second part 32 is in contact with the back face of the thermal head 10, thereby pressing the thermal head 10 toward the side where the platen roller 20 is situated. The head contact 33 is formed by bending the end of the second part 32 of the letter-V spring 30 into an arc shape.

The printer apparatus of the present embodiment utilizes such a letter-V spring 30, so that even in the case of the frame being made of resin material, the frame does not deform because the restoring force of the letter-V spring 30 is not applied to the wall of the frame extending in the width direction. It is thus safe to make the frame by use of resin material. Further, there is no need to provide a frame for supporting the letter-V spring 30, which enables the size reduction of the printer apparatus as well as cost reduction. As illustrated in FIGS. 5A and 5B, a projection 11 formed at an end of the thermal head 10 opposite from the side of the thermal head 10 for printing on printing paper (not shown) is inserted into a groove 34 formed in the first part 31 of the letter-V spring 30. The projection 11 is wedged between the first part 31 of the letter-V spring 30 and the recording paper guide 50 made of resin material. The projection 11 of the thermal head 10 serves as a rotation axis of the thermal head when the letter-V spring 30 presses the thermal head 10 toward the platen roller 20. FIG. 4B is a bottom view. FIG. 5A is a cross-sectional view taken along a dot-and-dash line 5A-5B in FIG. 5B. It may be noted that FIG. 5A shows a cross-sectional view taken at a different cross-sectional position than in FIG. 4.

Figure 6:
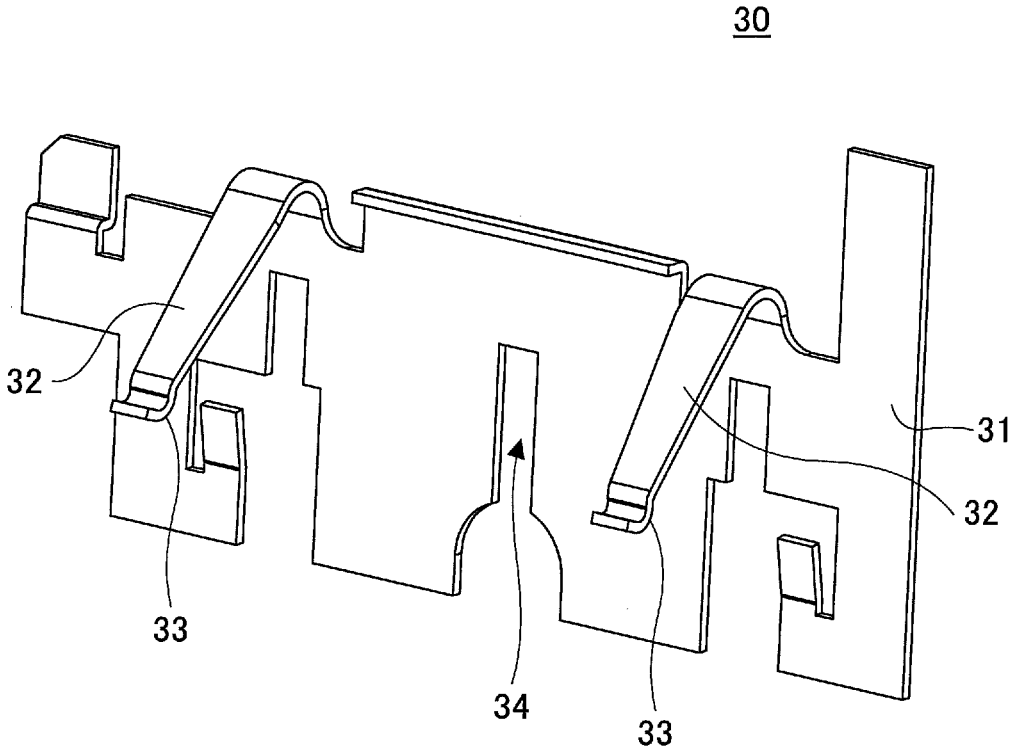
FIG. 6 is an axonometric view of a letter-V spring.

In the following, the letter-V spring 30 will be described in more detail with reference to FIG. 6. The letter-V spring 30 is of a leaf-spring type, and may be referred to as a V spring. The letter-V spring 30 has the first part 31 and the second part 32, which are parts of a single seamless, continuous metal plate. The portion of the metal plate that serves as the second part 32 is bent relative to the portion of the metal plate serving as the first part 31. More than one second part 32 may be formed in order to apply uniform pressure to the thermal head 10. The end of the second part 32 has the head contact 33 that comes in contact with the thermal head 10 for the purpose of applying a force to the thermal head 10. The first part 31 has a wide flat shape for serving as part of a frame, a center part of which has the groove 34 into which the projection 11 of the thermal head 10 can be inserted. The projection 11 of the thermal head 10 is wedged between the letter-V spring 30 and the recording paper guide 50 in the groove 34 of the first part 31 of the letter-V spring 30 such as to be rotatable. With this arrangement, the thermal head 10 is able to rotate around the projection 11 serving as a rotation axis.

The letter-V spring 30 is made of metal material such as stainless, and thus has the function to release heat generated by a conveyance motor 60 or the like, which will be described later. The letter-V spring 30 can also serve as part of the ground due to its high electrical conductivity. Further, the letter-V spring 30 has high strength, so that the first part 31 of the letter-V spring 30 may also constitute part of the housing of the printer apparatus.

Figure 7:
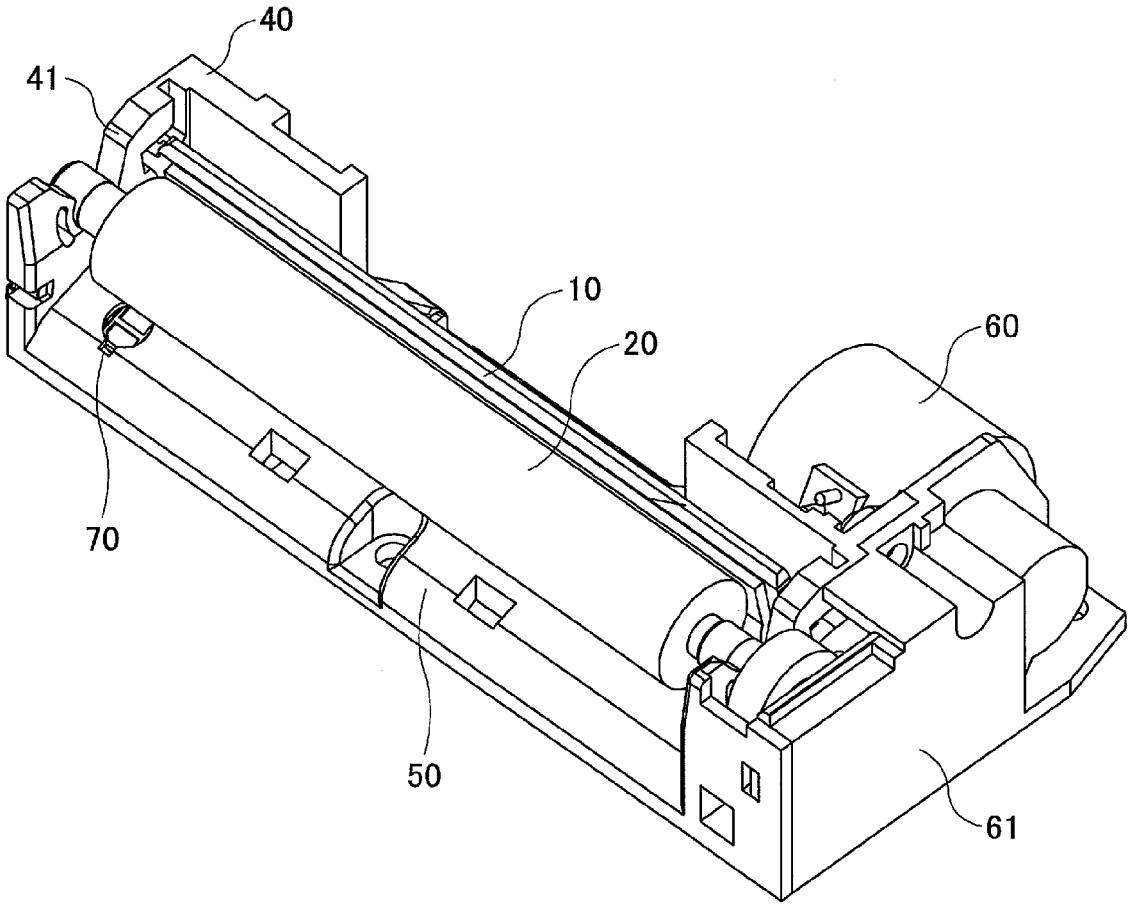
FIG. 7 is an axonometric view of the printer apparatus according to the present embodiment.
Figure 8:
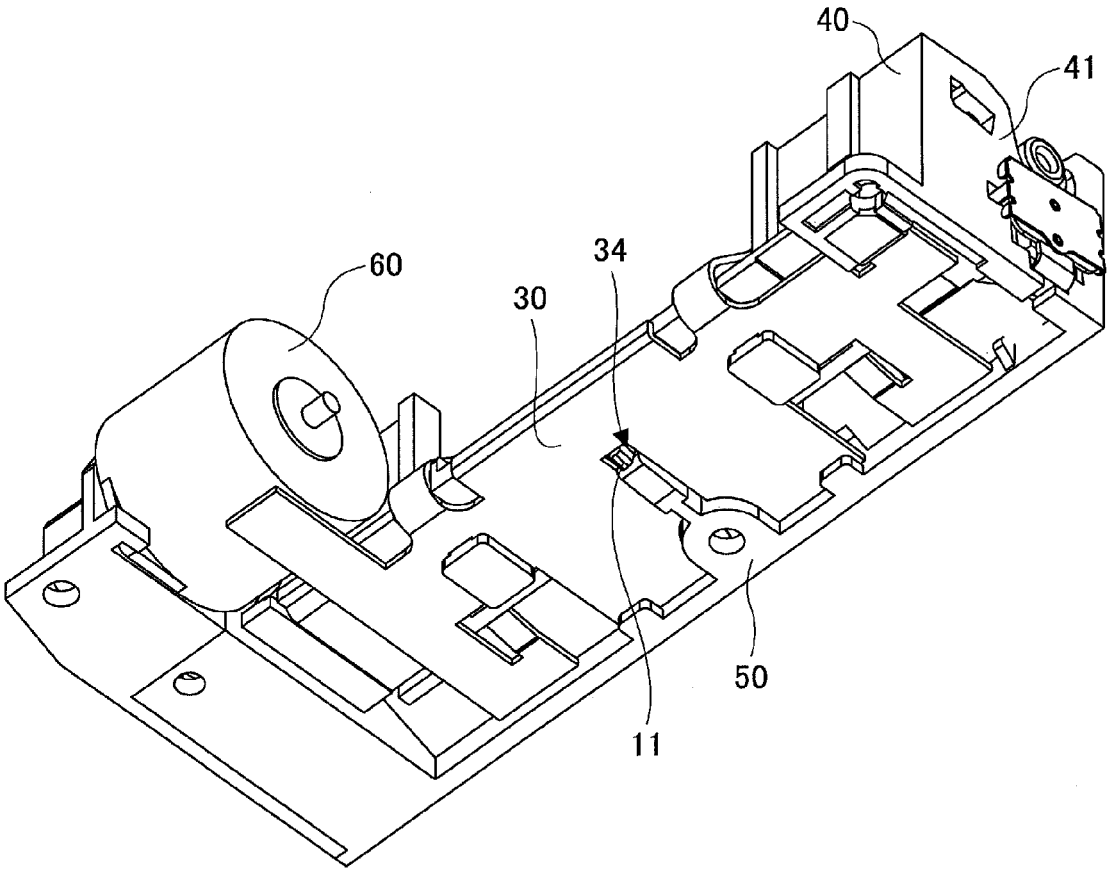
FIG. 8 is an axonometric view of the printer apparatus according to the present embodiment.

FIG. 7 and FIG. 8 are axonometric views of the printer apparatus of the present embodiment. The printer apparatus of the present embodiment includes the conveyance motor 60 for rotating the platen roller 20 and a gear box 61 for transmitting the rotation of the conveyance motor 60 to the platen roller 20. The recording paper guide 50 has an opening formed therein, at the position of which a recording paper sensor 70 is installed. The frame 40 of the printer apparatus has a frame side face 41.

Figure 9:
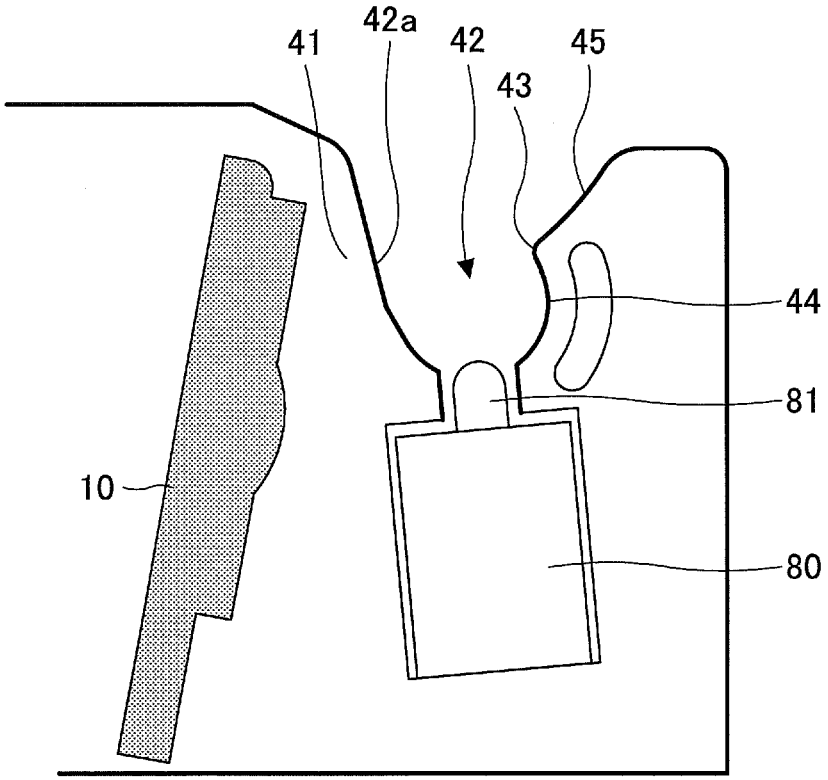
FIG. 9 is a drawing illustrating a platen supporting groove and a mechanical switch.
Figure 10:
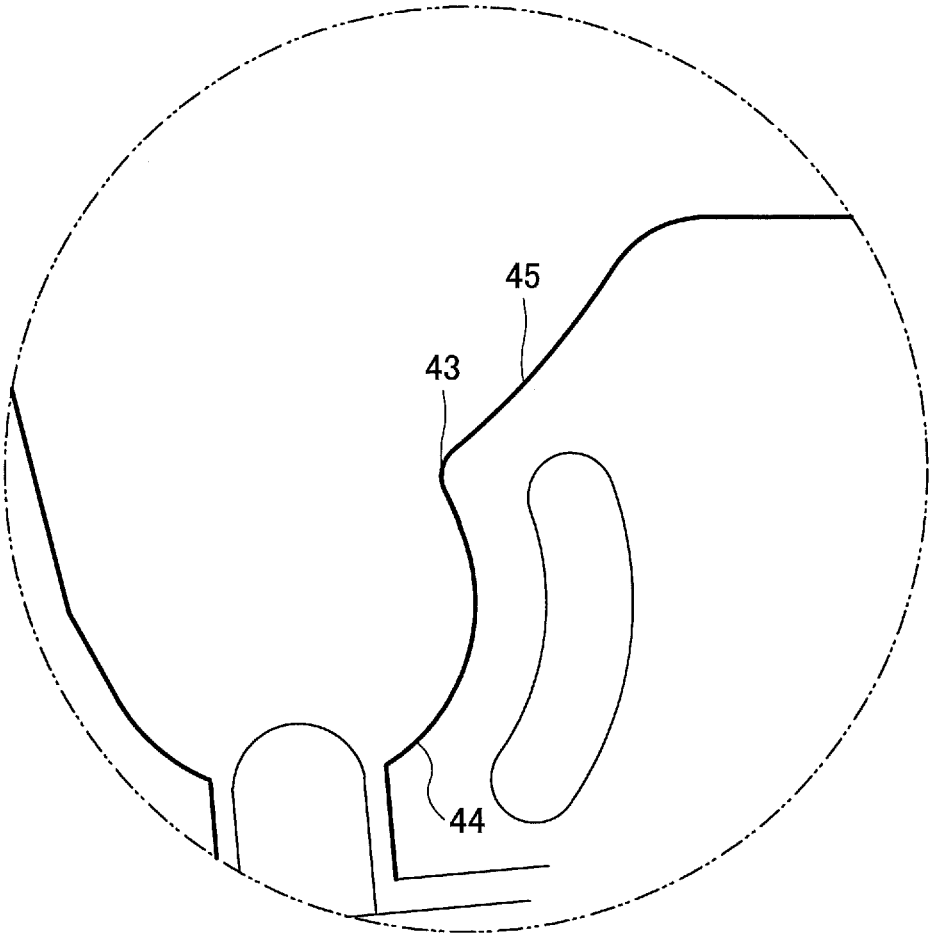
FIG. 10 is an enlarged view of a main part of the printer apparatus according to the present embodiment.

In the printer apparatus of the present embodiment, as illustrated in FIG. 9, the frame side face 41 of the frame 40 has a platen supporting groove 42 formed therein for supporting the rod 20*a* of the platen roller 20. The platen supporting groove 42 has a supporting-groove projection 43 formed on the edge thereof opposite from an edge 42*a* situated on the same side as the thermal head 10, such that the supporting-groove projection 43 projects towards inside the platen supporting groove 42. A first slope 44 is formed at a deeper depth into the platen supporting groove 42 than the supporting-groove projection 43 (i.e., below the supporting-groove projection 43 as illustrated in FIG. 9). A second slope 45 is formed further toward the entrance to the platen supporting groove 42 than the supporting-groove projection 43 (i.e., above the supporting-groove projection 43 as illustrated in FIG. 9). Further, the frame side face 41 has a mechanical switch 80 attached thereto that serves as a position detection switch to detect the rod 20*a* of the platen roller 20. Pressing a press part 81 of the mechanical switch 80 causes the press part 81 to be pressed down, thereby placing the mechanical switch 80 in the on or off state. FIG. 10 is an enlarged view of a portion of the platen supporting groove 42 where the supporting-groove projection 43, the first slope 44, and the second slope 45 are formed.

Figure 11:
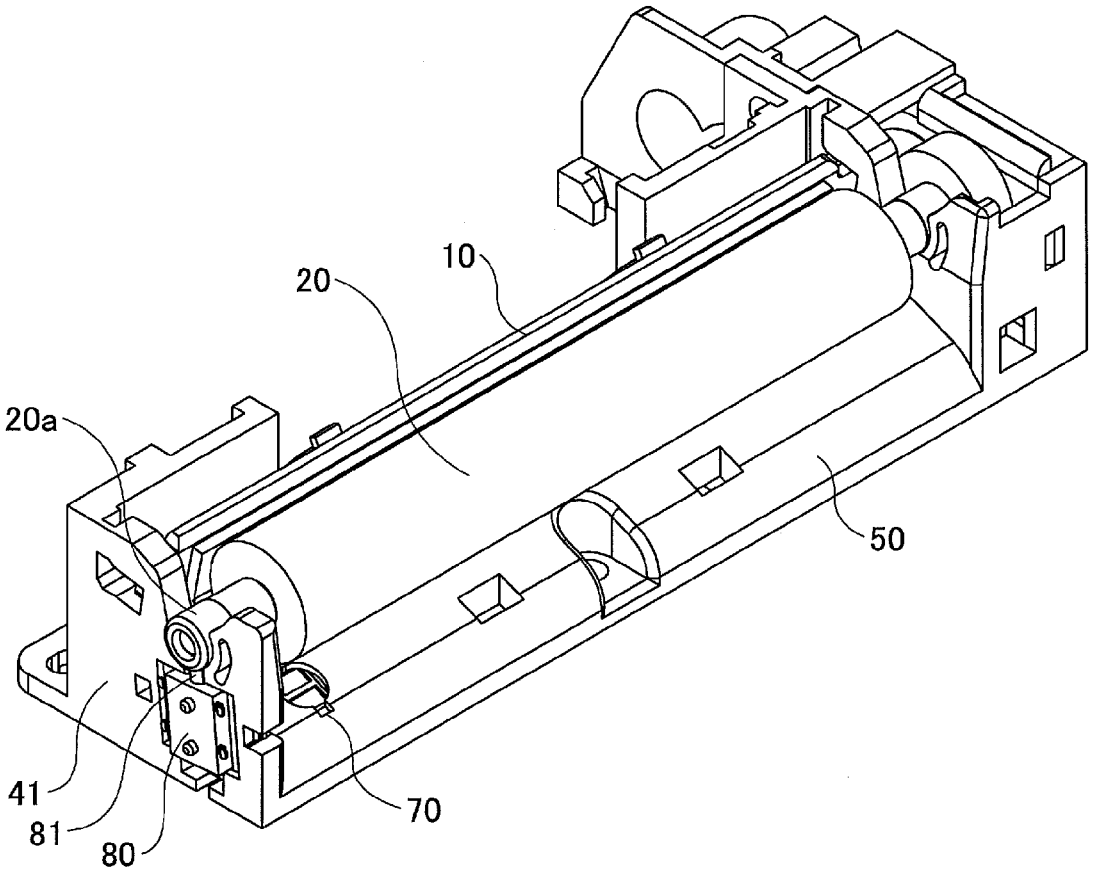
FIG. 11 is an axonometric view of the printer apparatus according to the present embodiment.

In the printer apparatus of the present embodiment, the event that the rod 20*a* of the platen roller 20 is installed at the predetermined position in the platen supporting groove 42 (see FIG. 9) as illustrated in FIG. 11 causes the rod 20*a* of the platen roller 20 to press and turn on or off the press part 81 of the mechanical switch 80. This allows the detection of the event that the rod 20*a* of the platen roller 20 is installed at the predetermined position in the platen supporting groove 42. Namely, the on or off state of the mechanical switch 80 enables the detection of whether the rod 20*a* of the platen roller 20 is installed at the predetermined position in the platen supporting groove 42.

Figure 12:
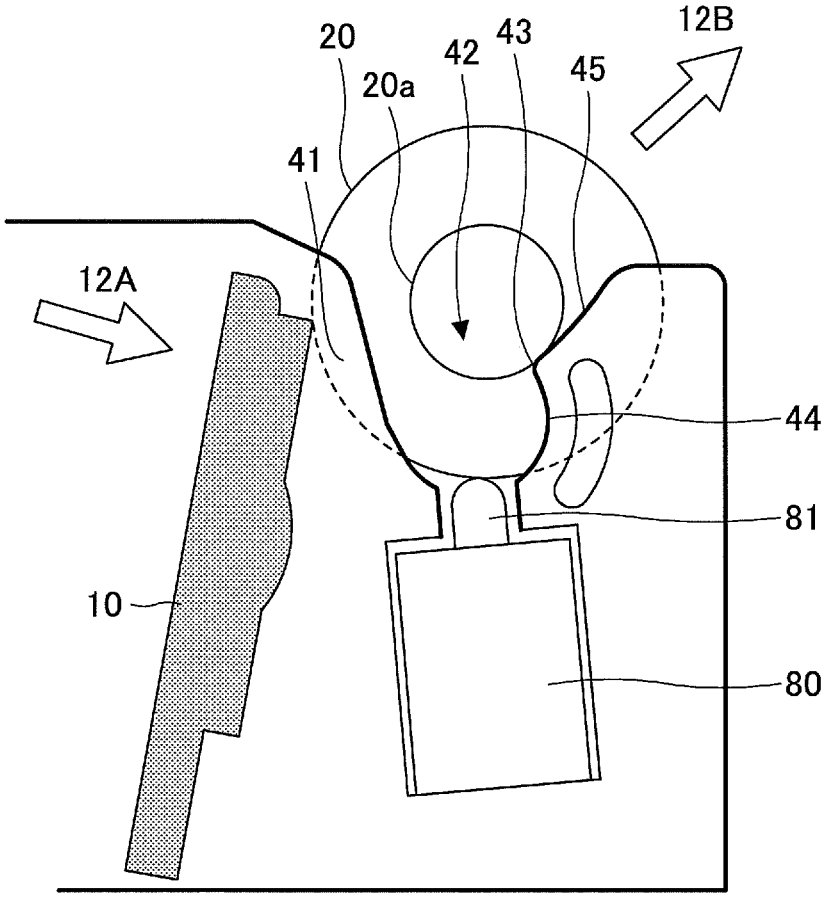
FIG. 12 is a drawing illustrating the printer apparatus of the present embodiment.

In the present embodiment, the letter-V spring 30 presses the thermal head 10 toward the direction of the platen roller 20. Namely, the restoring force of the letter-V spring 30 presses the platen roller 20 through the thermal head 10. In the state that is to be considered first, the rod 20*a* of the platen roller 20 is situated in the platen supporting groove 42 further toward the entrance to the platen supporting groove 42 than the supporting-groove projection 43 as illustrated in FIG. 12. In this case, the restoring force of the letter-V spring 30 acting in the direction indicated by an arrow 12A in FIG. 12 presses, and thus moves, the rod 20*a* of the platen roller 20 along the second slope 45 in the direction indicated by an arrow 12B in FIG. 12, so that the rod 20*a* of the platen roller 20 exits from the platen supporting groove 42.

Figure 13:
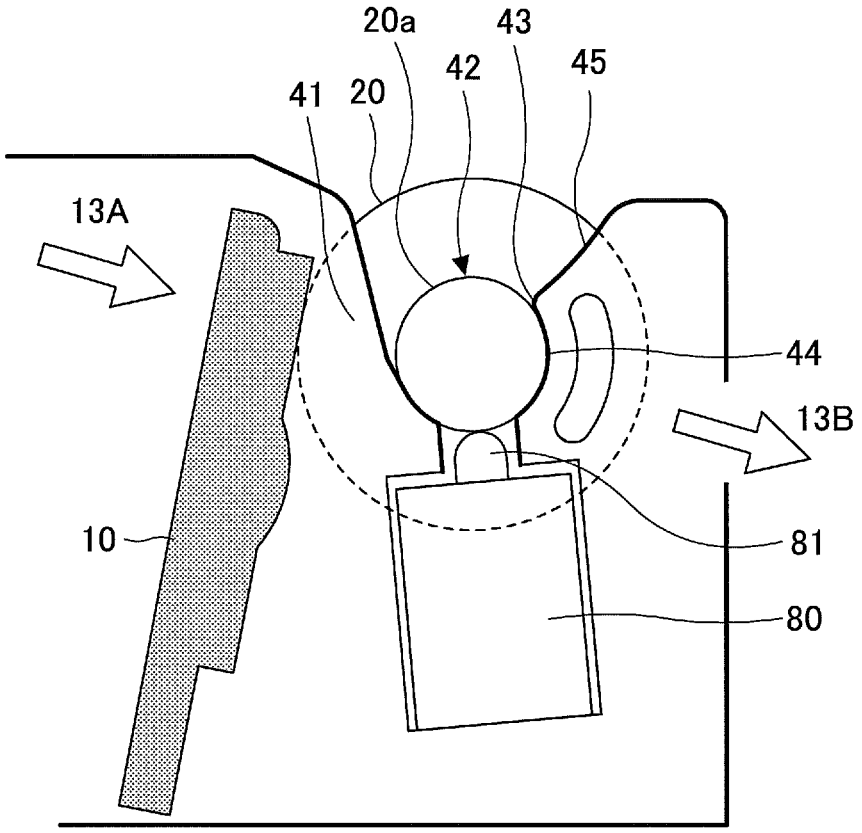
FIG. 13 is a drawing illustrating the printer apparatus of the present embodiment.
Figure 14:
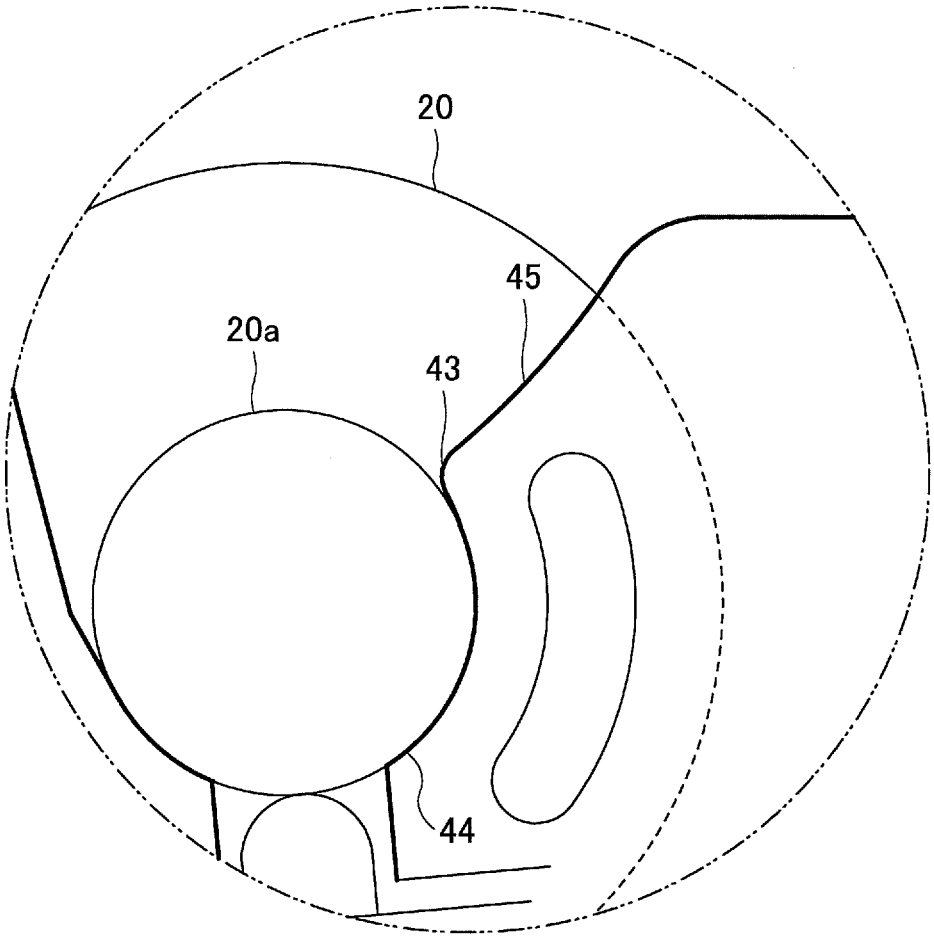
FIG. 14 is an enlarged view of a main part of the printer apparatus according to the present embodiment.

In the state that is to be considered next, the rod 20*a* of the platen roller 20 is situated at a deeper depth into the platen supporting groove 42 than the supporting-groove projection 43 of the platen supporting groove 42 as illustrated in FIG. 13. In this case, the restoring force of the letter-V spring 30 acting in the direction indicated by an arrow 13A in FIG. 13 presses, and thus moves, the rod 20*a* of the platen roller 20 along the first slope 44 in the direction indicated by an arrow 13B in FIG. 13, so that the rod 20*a* of the platen roller 20 is pressed into the predetermined position in the platen supporting groove 42. This allows the rod 20*a* of the platen roller 20 to be installed at the predetermined position in the platen supporting groove 42. It may be noted that FIG. 14 is an enlarged view of the rod 20*a* and the surrounding area when the rod 20*a* of the platen roller 20 is installed at the predetermined position in the platen supporting groove 42 as in FIG. 13. In the present embodiment, the shape of the first slope 44 is configured to conform to the curvature of the rod 20*a* of the platen roller 20.

In the manner described above, the letter-V spring 30 applies a restoring force to the platen roller 20 even in the state in which the rod 20*a* of the platen roller 20 is resting in position in the platen supporting groove 42, which thus keeps the rod 20*a* of the platen roller 20 secured in the platen supporting groove 42. In such a state, the restoring force of the letter-V spring 30 causes the rod 20*a* of the platen roller 20 to press and turn on or off the press part 81 of the mechanical switch 80, thereby enabling the detection of the fact that the rod 20*a* of the platen roller 20 is installed at the predetermined position in the platen supporting groove 42. The force by which the rod 20*a* of the platen roller 20 presses the press part 81 of the mechanical switch 80 is attributable to the restoring force of the letter-V spring 30.

In this manner, the present embodiment allows the number of springs to be reduced to one unlike the printer apparatus that needs two types of springs, i.e., the spring 930 (see FIG. 1) for pressing the thermal head 910 toward the platen roller 920 and the platen-rod holding spring 990 (see FIG. 3B) for holding the rod 920*a* of the platen roller 920 in the platen supporting groove 942. With this arrangement, the printer apparatus of the present embodiment enables the reduction of the number of components, thereby lowering the cost of the printer apparatus.

Further, although a description has been given with respect to one or more embodiments of the present invention, the contents of such a description do not limit the scope of the invention.

The present application claims foreign priority to Japanese priority application No. 2014-113251 filed on May 30, 2014 with the Japanese Patent Office, the entire contents of which are hereby incorporated by reference.

DESCRIPTION OF REFERENCE SYMBOLS

10 thermal head
11 rotational projection
20 platen roller
20*a* rod
30 letter-V spring
31 first part
32 second part
33 head contact
34 groove
40 frame
41 frame side face
42 platen supporting groove
43 supporting-groove projection
44 first slope
45 second slope
50 recording paper guide
60 conveyance motor
61 gear box
70 recording paper sensor
80 mechanical switch
81 press part

The invention claimed is:

1. A printer apparatus, comprising:

a print head;

a platen roller having a rod;

a spring configured to press the print head toward a direction of the platen roller;

a frame having in a side face thereof a platen supporting groove for supporting the rod of the platen roller; and a detection switch disposed in an opening formed in the side face of the frame, wherein the platen supporting groove includes a first edge situated toward a direction of the print head and a second edge situated opposite from the first edge, and has on the second edge a projection projecting toward inside the platen supporting groove, and wherein placing the rod of the platen roller at a predetermined position at a deeper side of the platen supporting groove than the projection causes the rod of the platen roller to press the detection switch due to an urging force that is applied to the platen roller by the spring through the print head.

2. The printer apparatus as claimed in claim 1, wherein the second edge of the platen supporting groove includes a first part formed at a deeper side of the platen supporting groove than the projection, and wherein in a state in which the rod of the platen roller is in contact with the first part, the rod of the platen roller is pressed through the print head by the spring to move along the first part, so that the rod of the platen roller is set at the predetermined position in the platen supporting groove.

3. The printer apparatus as claimed in claim 1, wherein the second edge of the platen supporting groove includes a second part formed further toward an entrance to the platen supporting groove than the projection, and wherein in a state in which the rod of the platen roller is in contact with the second part, the rod of the platen roller is pressed through the print head by the spring to move along the second part, so that the rod of the platen roller exits from the platen supporting groove.

4. The printer apparatus as claimed in claim 1, wherein the detection switch is a mechanical switch.

* * * * *